US006223374B1

(12) United States Patent
Lin

(10) Patent No.: US 6,223,374 B1
(45) Date of Patent: May 1, 2001

(54) PLIER DEVICE HAVING CHANGEABLE TOOL MEMBERS

(76) Inventor: Hsing Tai Lin, P.O. Box 63-99, Taichung, 406 (TW)

( * ) Notice: Subject to any disclaimer, the term of this patent is extended or adjusted under 35 U.S.C. 154(b) by 0 days.

(21) Appl. No.: 09/473,265

(22) Filed: Dec. 24, 1999

(51) Int. Cl.[7] ..... B25B 7/22
(52) U.S. Cl. ..... 7/127; 7/128; 7/129
(58) Field of Search ..... 7/127, 128, 129

(56) References Cited

U.S. PATENT DOCUMENTS 5,245,721 9/1993 Lowe et al. ..... 7/129
5,697,114 * 12/1997 McIntosh et al. .
5,960,498 * 10/1999 Nabors et al. .
6,023,805 * 2/2000 Lin .

* cited by examiner

*Primary Examiner*—Timothy V. Eley
*Assistant Examiner*—Willie Berry, Jr.

(57) ABSTRACT

A plier device includes two handles each having an open channel formed in one end, and a pair of rods pivotally secured together at a middle pivot pin. The rods include two ends each having a pair of jaws. The jaws each includes a rib engaged into the channels of the handles for detachably securing the tool device to the handles. The handles each includes a pair of flanges extended inward of the channel, the jaws each includes a pair of opposite grooves for receiving the flanges of the handles. The handles each has a spring-biased projection engaged with the jaws.

5 Claims, 3 Drawing Sheets

PLIER DEVICE HAVING CHANGEABLE TOOL MEMBERS

BACKGROUND OF THE INVENTION

1. Field of the Invention

The present invention relates to a plier device, and more particularly to a plier device having two tool members that may be changed with each other.

2. Description of the Prior Art

A typical plier device is disclosed in U.S. Pat. No. 5,245,721 to Lowe et al. and comprises a pair of jaw elements pivotally coupled to the handles and each including two ends each having a tool member provided thereon. The tool members may not be easily and quickly replaced or changed with each other.

The present invention has arisen to mitigate and/or obviate the afore-described disadvantages of the conventional plier devices.

SUMMARY OF THE INVENTION

The primary objective of the present invention is to provide a plier device including a pair of tool members that may be easily and quickly and changeably secured to the handles.

In accordance with one aspect of the invention, there is provided a plier device comprising a pair of handles each including a first end having a channel formed therein and opened relative to the handles respectively and facing toward each other, and a tool device including a pair of rods, the rods including a middle portion pivotally secured together at a pivot pin for allowing the rods to be rotated about the pivot pin and including two ends each having a pair of jaws formed and provided therein, the jaws each including a rib formed thereon and engaged into the channels of the handles respectively for detachably securing the tool device to the handles.

The handles each includes a pair of flanges extended inward of the channel respectively, the jaws each includes a pair of opposite grooves formed therein for defining the rib and for receiving the flanges of the handles respectively.

A securing device is further provided for detachably securing the jaws to the handles respectively and includes a pair of spring-biased projections disposed in the handles respectively and engaged with the jaws for detachably securing the jaws to the handles respectively. The jaws of the tool device each includes a recess formed therein for receiving the spring-biased projections and for securing the jaws to the handles.

The first ends of the handles each includes a block provided therein and having the channels formed therein respectively.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
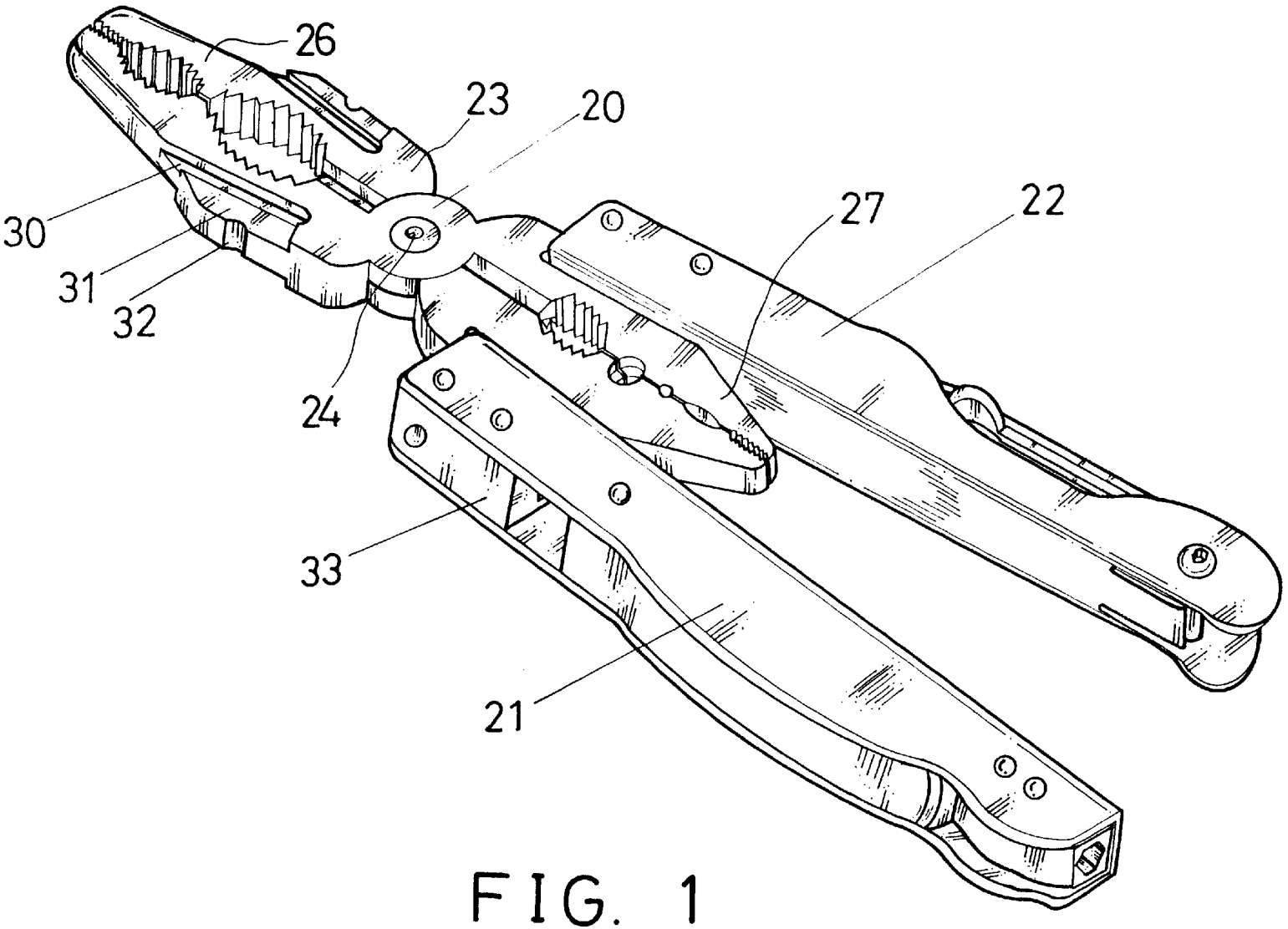
FIG. 1 is a perspective view of a plier device in accordance with the present invention.
Figure 2:
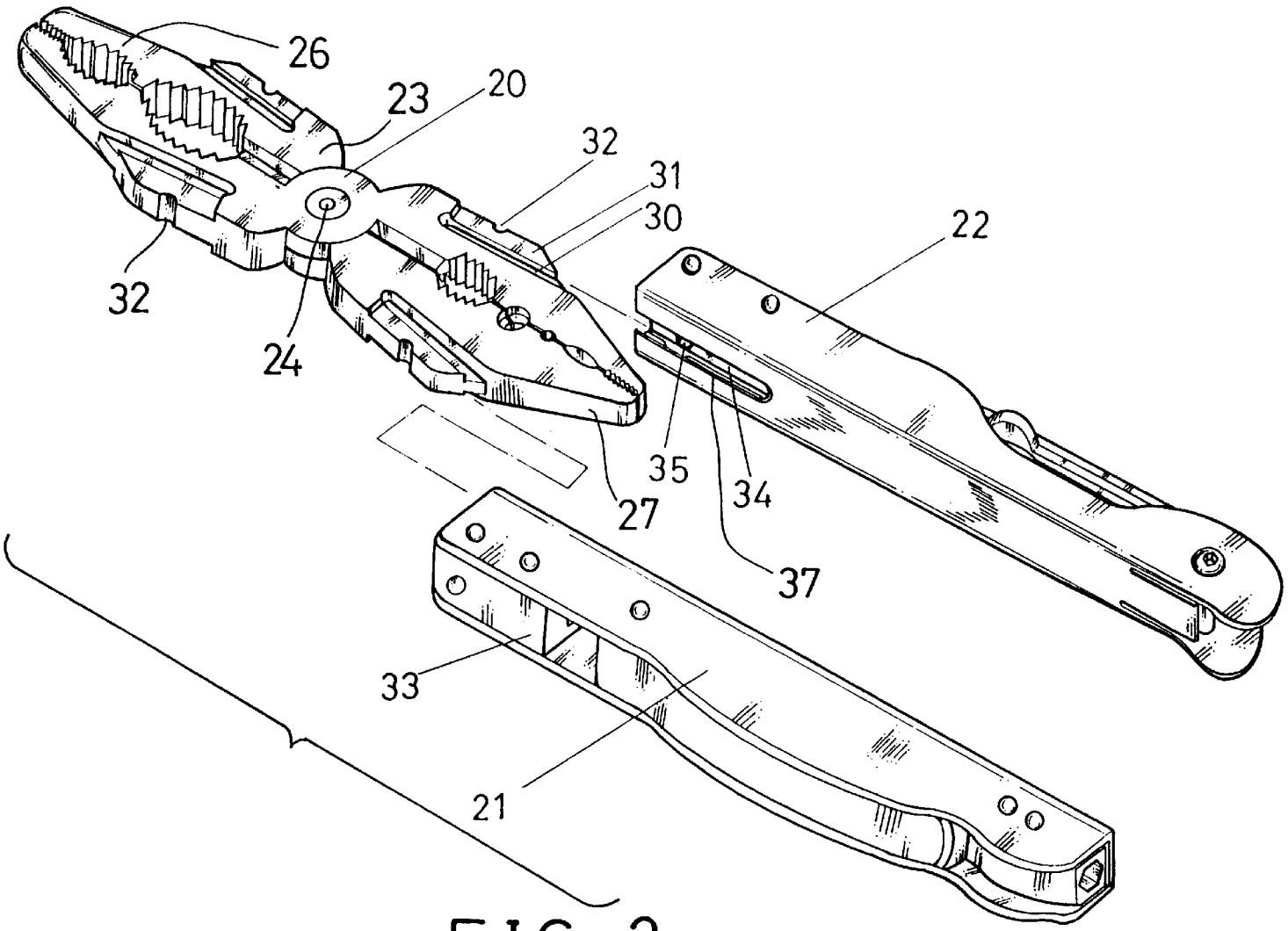
FIG. 2 is an exploded view of the plier device.

Referring to the drawings, and initially to FIGS. 1 and 2, a plier device in accordance with the present invention comprises a pair of handles 21, 22 each includes a block 33 secured to one end thereof and each includes a channel 34 formed in the one end thereof and opened toward the inner side of the respective handle 21, 22 and facing inward or toward each other. The handles 21, 22 each includes a pair of opposite flanges 37 extended inward of the respective channel 34 and extended toward each other, and each includes a spring-biased projection 35 provided therein and extended inward of the respective channel 34 of the handle 21, 22.

A tool device 20 includes a pair of rods 23 having a middle portion pivotally secured together at a pivot pin 24 and having a pair of jaws 26 formed in one end and having the other pair of jaws 27 formed in the other end thereof. The jaws 26, 27 each includes a pair of opposite longitudinal grooves 30 formed therein for slidably receiving the flanges 37 of the handles 21, 22 and defined by a pair of opposite longitudinal ribs 31 which is engaged into the respective channels 34 of the handles 21, 22. The jaws 26, 27 may be secured to the handles 21, 22 with a force-fitted engagement. The jaws 26, 27 may each further includes a recess 32 formed in the side portion thereof for receiving the spring-biased projection 35 and for further positioning and securing the jaws 26, 27 to the handles 21, 22 respectively.

In operation, the grooves 30 and the ribs 31 of the jaws 26, 27 may be changeably engaged with the flanges 37 and the channels 34 of the handles 21, 22 for allowing the jaws 26, 27 may be easily and quickly changed with each other without additional tools.

Figure 3:
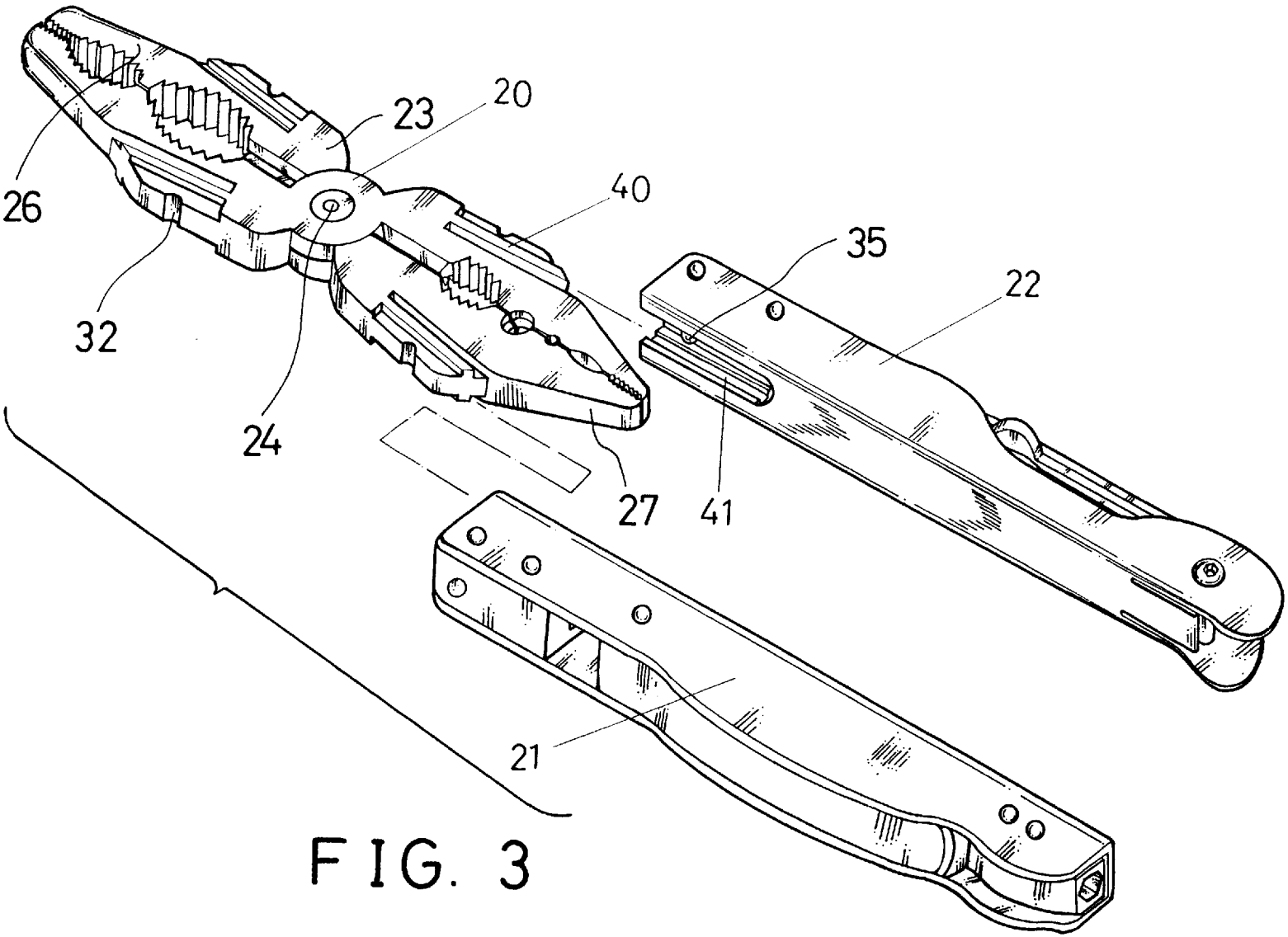
FIG. 3 is an exploded view illustrating the other application of the plier device.

Referring next to FIG. 3, the channels 41 of the handles 21, 22 may include various kinds of shapes, such as the cross-shaped as shown in FIG. 3. The jaws 26, 27 may include a corresponding latch 40 of the corresponding cross-shape for engaging into the respective channels 41 of the handles 21, 22 and for allowing the jaws 26, 27 of the tool device 20 to be easily and quickly changed with each other.

Accordingly, the plier device in accordance with the present invention includes a pair of tool members that may be easily and quickly and changeably secured to the handles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A plier device comprising:

a pair of handles each including a first end having a channel formed therein and opened relative to said handles respectively and facing toward each other, said handles each including a pair of flanges extended inward of said channel respectively, and a tool device including a pair of rods, said rods including a middle portion pivotally secured together at a pivot pin for allowing said rods to be rotated about said pivot pin and including two ends each having a pair of jaws formed and provided therein, said jaws each including a rib formed thereon and engaged into said channels of said handles respectively for detachably securing said tool device to said handles, and said jaws each including a pair of opposite grooves formed therein for defining said rib and for receiving said flanges of said handles respectively.

2. The plier device according to claim 1 further comprising means for detachably securing said jaws to said handles respectively.

3. A plier device comprising:

a pair of handles each including a first end having a channel formed therein and opened relative to said handles respectively and facing toward each other, a tool device including a pair of rods, said rods including a middle portion pivotally secured together at a pivot pin for allowing said rods to be rotated about said pivot pin and including two ends each having a pair of jaws formed and provided therein, said jaws each including a rib formed thereon and engaged into said channels of said handles respectively for detachably securing said tool device to said handles, and means for detachably securing said jaws to said handles respectively, said detachably securing means including a pair of spring-biased projections disposed in said handles respectively and engaged with said jaws for detachably securing said jaws to said handles respectively.

4. The plier device according to claim 3, wherein said jaws of said tool device each includes a recess formed therein for receiving spring-biased projections and for securing said jaws to said handles.

5. A plier device comprising:

a pair of handles each including a first end having a channel formed therein and opened relative to said handles respectively and facing toward each other, said first ends of said handles each including a block provided therein and having said channels formed therein respectively, and a tool device including a pair of rods, said rods including a middle portion pivotally secured together at a pivot pin for allowing said rods to be rotated about said pivot pin and including two ends each having a pair of jaws formed and provided therein, said jaws each including a rib formed thereon and engaged into said channels of said handles respectively for detachably securing said tool device to said handles.

* * * * *